US007196666B2

(12) United States Patent
Allen et al.

(10) Patent No.: US 7,196,666 B2
(45) Date of Patent: Mar. 27, 2007

(54) SURFACE MICROMACHINED MILLIMETER-SCALE RF SYSTEM AND METHOD

(75) Inventors: Mark G. Allen, Atlanta, GA (US); Yong-Kyu Yoon, Smyrna, GA (US); Jin-Woo Park, Suwanee, GA (US); Yeun-Ho Joung, Suwanee, GA (US); Florent Cros, Decatur, GA (US); Ioannis Papapolymerou, Decatur, GA (US); Emmanouil Tentzeris, Atlanta, GA (US); Bo Pan, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 0 days.

(21) Appl. No.: 11/145,911

(22) Filed: Jun. 6, 2005

(65) Prior Publication Data

US 2006/0017650 A1 Jan. 26, 2006

Related U.S. Application Data

(60) Provisional application No. 60/576,889, filed on Jun. 4, 2004.

(51) Int. Cl.
*H01Q 1/38* (2006.01)

(52) U.S. Cl. ..... 343/700 MS; 343/702; 343/846

(58) Field of Classification Search ..... 343/700 MS, 343/846, 833, 834, 702
See application file for complete search history.

(56) References Cited

U.S. PATENT DOCUMENTS 6,556,172 B2 * 4/2003 Noro ..... 343/715
6,833,816 B2 * 12/2004 Hilgers ..... 343/700 MS

OTHER PUBLICATIONS

Yoon, YK, Park, JW, and Allen, M.G., "RF MEMS Based On Epoxy-Core Conductors," Digest from Solid-State Sensor, Actuator and Microsystems Workshop, Hilton Head Island, South Carolina, Jun. 2-6, 2002, pp. 374-375.

* cited by examiner

*Primary Examiner*—Hoang V. Nguyen
(74) *Attorney, Agent, or Firm*—Thomas, Kayden, Horstemeyer & Risley LLC

(57) ABSTRACT

A surface micromachined electromagnetically radiating antenna includes a coplanar waveguide on a ground plane coated substrate having a conductor path. The conductor path is coupled to a monopole conductor, which has a generally-cylindrical backbone erected vertically from the substrate and a metal layer deposited on the backbone at a predetermined thickness. The antenna may be fabricated by depositing an epoxy on the ground plane coated substrate to a predetermined depth and according to a pattern. The epoxy is exposed to an ultraviolet source that develops one or more columns according to the pattern. A seed layer of metal may be formed on the developed column. A conductive metal is electrodeposited over the column surface to produce the monopole antenna. Other antenna may be created by adding monopoles and/or conductive metal patches and/or strips that are positioned atop the monopoles and elevated from the substrate.

21 Claims, 17 Drawing Sheets

200

200

SURFACE MICROMACHINED MILLIMETER-SCALE RF SYSTEM AND METHOD

CROSS REFERENCE TO RELATED APPLICATION

This application claims priority to U.S. provisional application entitled, "Surface Micromachined Millimeter-Scale RF Systems," having serial no. 60/576,889, filed Jun. 4, 2004, which is entirely incorporated herein by reference.

TECHNICAL FIELD

The present disclosure generally pertains to antennas, and more particularly to systems and methods for fabricating surface micromachined vertical radiating structures.

BACKGROUND

Millimeter-wave (MMW) devices are valued for their ability to provide very-broad-bandwidth wireless communication in both space and terrestrial applications. Examples include satellite, radar, mobile collision detection, imaging, and indoor local communications. One aspect of wireless millimeter-wave systems is their radiating structures, i.e., the antenna. Planar MMW antennas, such as microstrip antennas or printed-circuit patch antennas, are widely used due to their ease of manufacture, low cost, simple fabrication, and relative ease of integration with monolithic systems. However, patch antennas can suffer from relatively narrow bandwidth, substrate dielectric loss, mutual coupling with their substrate, and surface wave perturbation issues. Although wire antennas (i.e., dipole or monopole antennas) or cavity antennas can be considered as alternatives to printed-circuit patch antennas due to their broad bandwidth, low loss, and reduced dependence on substrate, fabrication difficulty has prevented them from being efficiently implemented in a cost effective, integrated fashion.

Increases in operation frequencies of RF systems have pushed characteristic sizes of RF sub-elements small enough, but advances in fabrication technologies have, to date, not been such that surface micro-machine components have been sufficiently large to create reliable radiators in the desired millimeter-wave frequency range. FIG. 1 is a nonlimiting exemplary diagram of a plate molding process for fabricating a monopole antenna. In this nonlimiting example 10, a mold 12 having a hole 13 may be placed on substrate 15, such that a conductor material may be deposited in hole 13 to create the monopole column 17 of FIG. 1. In order to produce the monopole column 17, the mold 12 is removed so as to leave the remaining column 17 vertically extending from substrate 15.

However, fabrication techniques such as described above to produce monopole antenna column 17 are difficult and costly due to the problems associated with removing the mold 12 without damaging or perhaps destroying the monopole antenna 17. Because of these difficulties and cost issues, the achievable thicknesses and vertical heights of monopole antenna 17 have been limited, thereby precluding the available frequencies precluding application in certain millimeter-wave frequencies.

However, with a growing demand for higher data rate and affordable communication modules, increasing bandwidth and reduced fabrication costs have come into sharper focus, especially in the millimeter frequency range. Moreover, use of cylindrical monopole antennas such as monopole antenna 17 of FIG. 1 are desired in such applications due to their broad impedance bandwidths. But, as described above in regard to FIG. 1, one problem in addition to column height relates to difficulties in transitioning from 2-D components to 3-D components. It is generally more complicated to create a 3-D transition from the planar transmission systems that may be placed on substrate 15 as coupled to the monopole antenna 17 than for printed circuit antennas. As a nonlimiting example, for lower frequency systems, a cylindrical monopole antenna, such as monopole antenna 17 of FIG. 1, may be fed from the backside of substrate 15 by a coaxial line (not shown); however, this fabrication technique includes an etching process that may be overly costly.

Thus, there is a heretofore unaddressed need to overcome these deficiencies and shortcomings described above.

DESCRIPTION OF THE DRAWINGS

Many aspects of this disclosure can be better understood with reference to the following drawings. The components in the drawings are not necessarily to scale, emphasis instead being placed upon clearly illustrating the principals of the present disclosure. Moreover, in the drawings, like reference numerals designate corresponding parts throughout the several views.

In addition to the drawings discussed above, this description describes one or more embodiments as illustrated in the above-referenced drawings. However, there is no intent to limit this disclosure to a single embodiment or embodiments that are disclosed herein. On the contrary, the intent is to cover all alternatives, modifications, and equivalents included within the spirit and scope of this disclosure and as defined by the appended claims.

FIG. 18 is a diagram of a magnetically lifted monopole antenna that may be erected vertically for application such as also with the antenna of FIG. 4.

DETAILED DESCRIPTION

In addition to the drawings discussed above, this description describes one or more embodiments as illustrated in the above-referenced drawings. However, there is no intent to limit this disclosure to a single embodiment or embodiments that are disclosed herein. On the contrary, the intent is to cover all alternatives, modifications, and equivalents included within the spirit and scope of this disclosure and as defined by the appended claims.

A surface micromachined electromagnetically radiating antenna includes a coplanar waveguide on a ground plane coated substrate having a conductor path. The conductor path is coupled to a monopole conductor, which has a generally-cylindrical backbone erected vertically from the substrate and a metal layer deposited on the backbone at a predetermined thickness. The antenna may be fabricated by depositing an epoxy on the ground plane coated substrate to a predetermined depth and according to a pattern. The epoxy is exposed to an ultraviolet source that develops one or more columns according to the pattern. A seed layer of metal may be formed on the developed column. A conductive metal is electrodeposited over the column surface to produce the monopole antenna. Other antenna may be created by adding monopoles and/or conductive metal patches and/or strips that are positioned atop the monopoles and elevated from the substrate.

Figure 1:
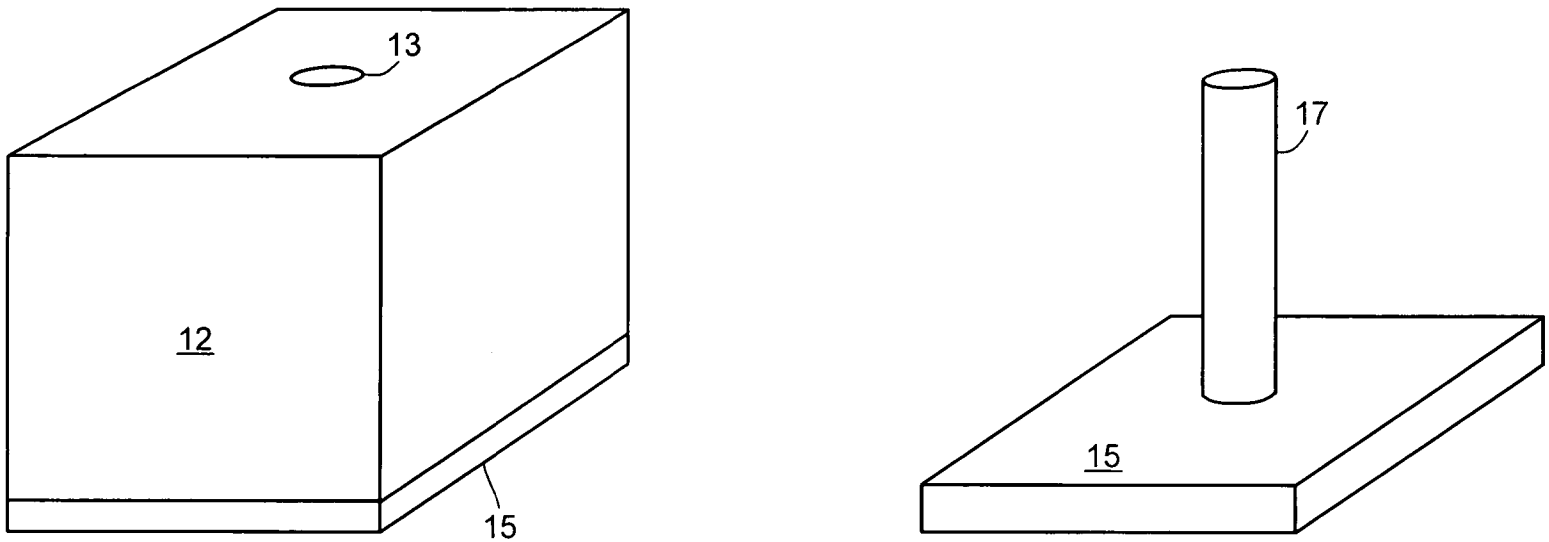
FIG. 1 is a diagram of a molded cylindrical monopole antenna.
Figure 2:
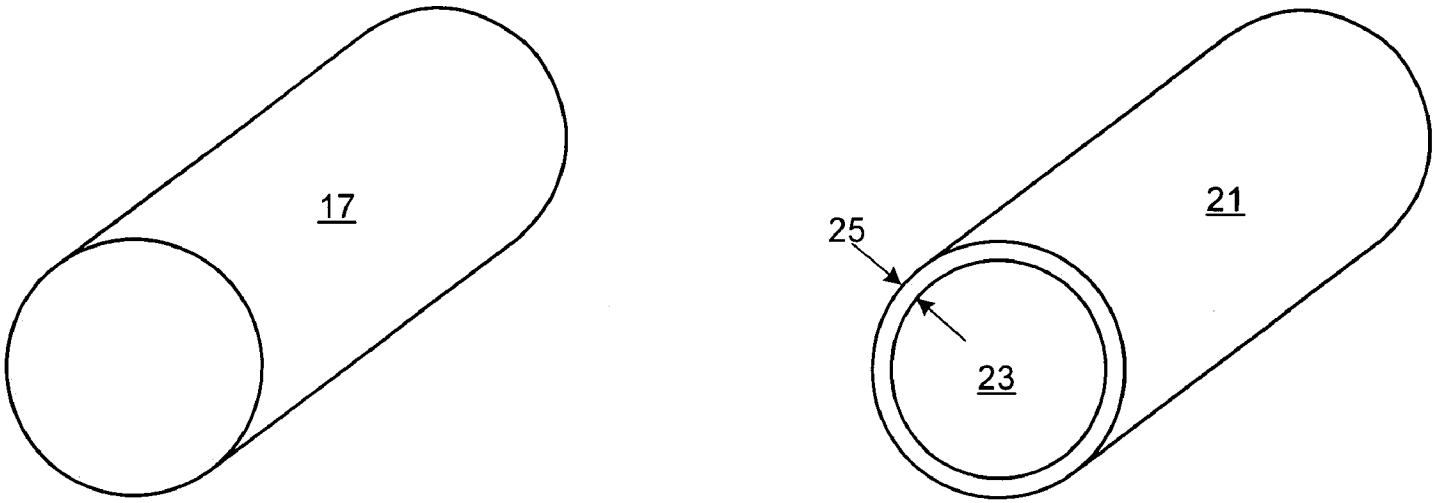
FIG. 2 is a diagram of the column of the cylindrical monopole antenna of FIG. 1 and a hollowed version of the cylindrical conductor column.

FIG. 2 is a diagram of the column 17 of cylindrical monopole antenna of FIG. 1 and a hollowed cylindrical conductor 21. An electromagnetic wave propagating through conductor 17 attenuates quickly in the depth direction of the conductor 17. Thus, the resultant electric current flows through the outermost portion of the conductor. The conductors 17 and 21 may generally be recognized as equivalent conductors even though conductor 21 contains a hollowed portion 23 throughout its length, thereby leaving thickness 25. However, since at GHz frequencies, currents are generally confined to the outermost portion of the conductors, as described above, the hollowed portion 23 of conductor 21 causes little effectual difference in the radiating capabilities of conductor 21. Thus, the hollow conductor 21 may be equivalent to the solid conductor 17 if t is greater than or equal to 5 δ, where δ may be represented as $$\delta = \sqrt{\frac{2}{\omega\mu\sigma}}.$$

Figure 3:
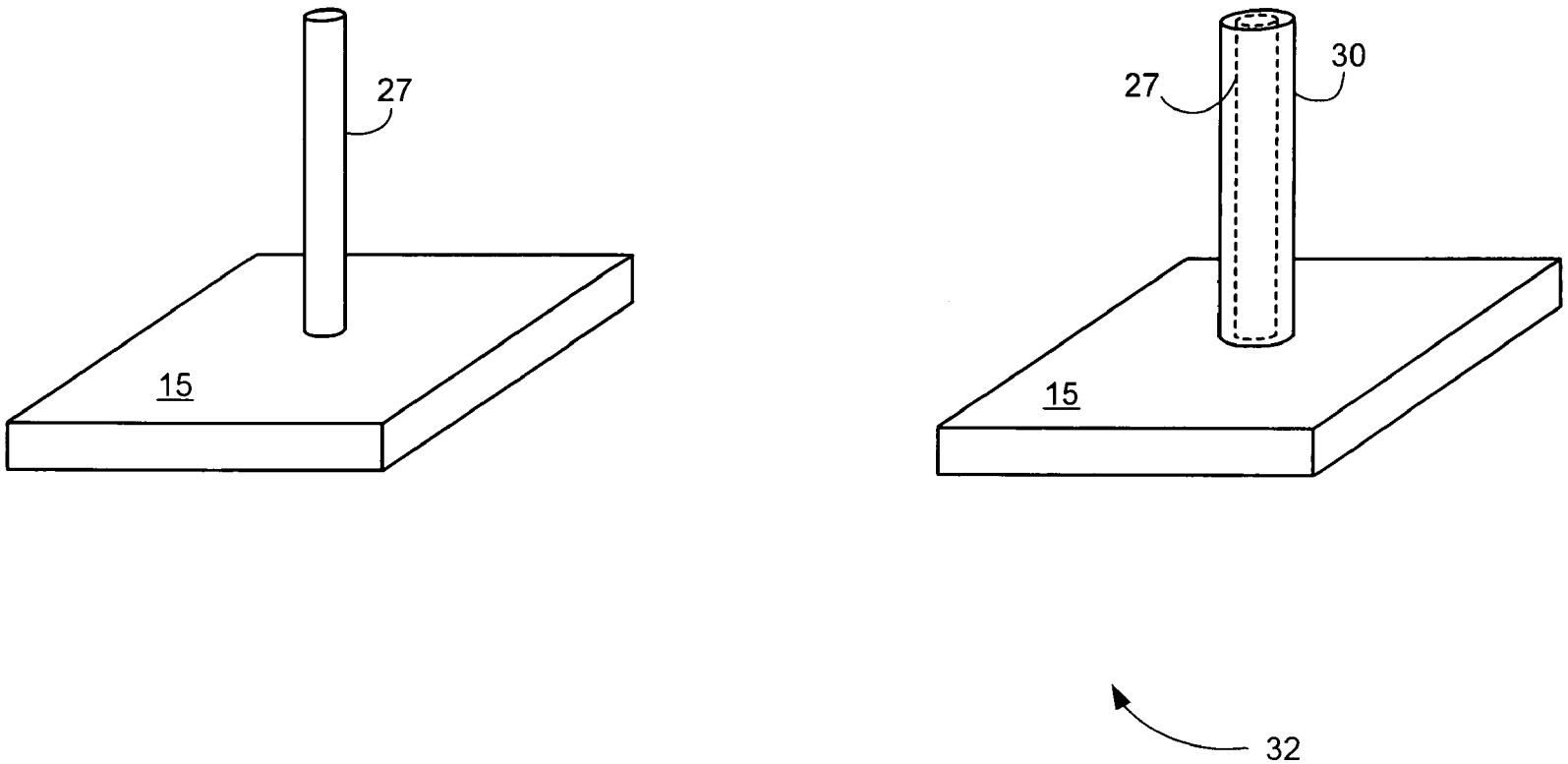
FIG. 3 is a diagram of a cylindrical monopole antenna, such as in FIG. 1, but having a hollowed conductor, as shown in FIG. 2.

Since a hollow conductor 21 may be used instead of a solid conductor 17, the fabrication technique for creating the monopole antenna, such as in FIG. 1, may be likewise adjusted. FIG. 3 is a diagram of a cylindrical monopole antenna 32, such as in FIG. 1, but having a hollowed conductor, as shown in FIG. 2. In this nonlimiting example, a substrate 15 may be coupled to a scaffolding or a backbone device 27, which may be constructed of a variety of materials, as one of ordinary skill in the art would know. As a nonlimiting example, the backbone 27 may be constructed of an epoxy material, such as SU-8 or the like. Upon creation of the backbone 27, a metalization process may subsequently follow wherein a conductor material may be coated over backbone 27 so as to create a monopole antenna 32. Thin (micron-scale) metal layers may be deposited on the 3-dimensional (3-D) epoxy backbone 27 so as to create a metalized column.

Figure 4:
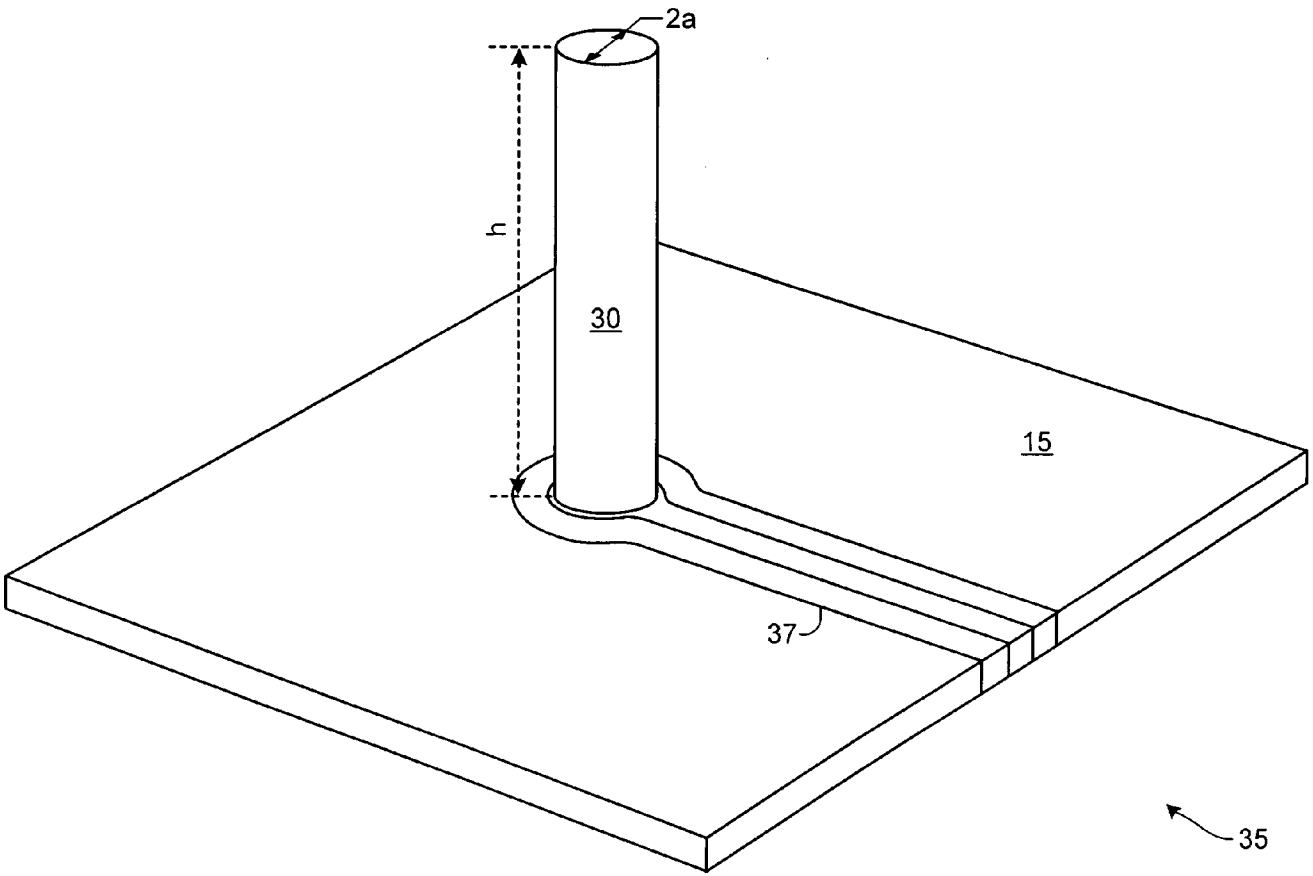
FIG. 4 is a diagram of the monopole antenna of FIG. 3 with a coplanar waveguide.

FIG. 4 is a diagram of a W-band (75 GHz–110 GHz), coplanar waveguide (cpw)-fed, quarter-wavelength monopole antenna 35, as shown in FIG. 3. The monopole antenna column 30 may be fed using coplanar waveguide 37 that provides simple connectivity to other components and ease of fabrication, as compared to an approach that passes through substrate 15, as described above. The epoxy core 27 (not shown in FIG. 4, but depicted in FIG. 3) may be used to provide a transition from the 2-D coplanar waveguide 37 to the 3-D monopole antenna column 30. The monopole antenna 35 may be fabricated by a low-temperature foundry-compatible process, as described below; fully-integrated millimeter-wave systems are thereby feasible.

The achievable aspect-ratio (height to diameter ratio, h/2a) as well as the achievable monopole height may be functions of the frequency range of interest. As a nonlimiting example, the height of the quarter-wave monopole 35 in W-band (75 GHz–110 GHz) may be in the range of 1 mm to 680 μm. In practice, the monopole antenna 35 may be cylindrical with a diameter of 2a rather than an ideal wire with zero thickness. The non-ideal cylindrical monopole antenna 35, therefore, may have an inductive reactance term attributable to the non-zero width of the conductor when it is driven at the radiating resonance frequency of an ideal monopole of the same height. This reactance term results in a non-ideal monopole having its actual resonance at a slightly lower frequency than that of an ideal monopole.

Figure 5:
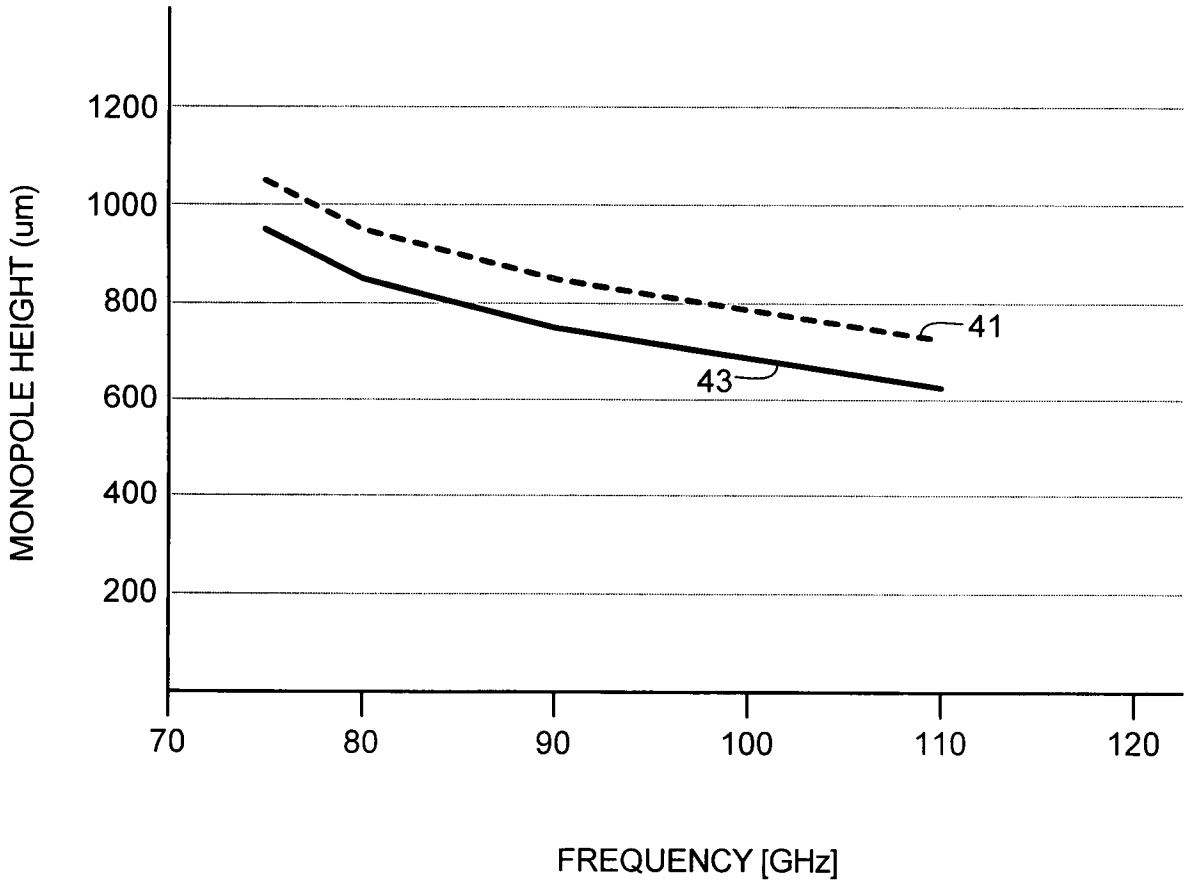
FIG. 5 is an exemplary diagram of characteristics of the monopole antenna of FIG. 4.

FIG. 5 is an exemplary diagram of characteristics of the monopole antenna 35 of FIG. 4. If a particular resonant frequency is desired, the monopole height h may be reduced to achieve the ideal monopole resonant frequency. The magnitude of this height correction may depend on the aspect-ratio of column 30. As a nonlimiting example, if the fabrication-limited aspect ratio is 10, the height h of a quarter-wave monopole may be given to be 0.228 λ. The height of the quarter-wave monopole needed for radiation resonance in the W-band may be shown in FIG. 5.

As shown in FIG. 5, dotted line 41 represents an uncompensated ideal monopole antenna having an aspect ratio of 10. Likewise, solid line 43 represents a compensated practical monopole antenna also having an aspect ration of 10. In addition to the height corrections discussed above, it may be noted that the thicker the cylindrical monopole antenna (i.e., the lower the aspect ratio), the wider its bandwidth may become and the less sharp its band-selectivity may also become.

Although the actual radiation resistance may be calculated using methods that take into account parasitics, driving elements, and imperfect ground planes, the empirical radiation resistance $R_A$ may be represented by the following equation:

$$R_A = 12.35(2\pi h/\lambda)^{2.4}.$$

Using a fabrication-limited aspect ratio of 10, and a resultant height of 0.228 λ, the predicted radiation resistance may be calculated as 29.3 Ω. The ohmic resistance $R_{ohmic}$ of the antenna conductor 30 may be represented according to the following equation:

$$R_{ohmic}[\Omega] = R_s \frac{h}{2\pi a},$$

where $R_S$ is the surface resistance, or sheer resistance, which may be defined as $$R_s = \sqrt{\frac{\omega\mu}{2\sigma}},$$

where ω, μ, and σ are the radiation frequency, permeability of the conductor, and the conductivity of the conductor, respectively.

If the wire is constructed of gold ($\sigma=4.1*10^7$ S/m), the surface resistance $R_S$ at 85 GHz may be calculated to be 0.092 Ω/sq. With h of 800 μm, and a radius "a" of 40 μm, $R_{ohmic}$ is 0.29 Ω. The ohmic resistance of the wire is less than 1% of the radiation resistance. Thus, the antenna input resistance can be approximated by the antenna radiation resistance in resonance mode.

Figure 6:
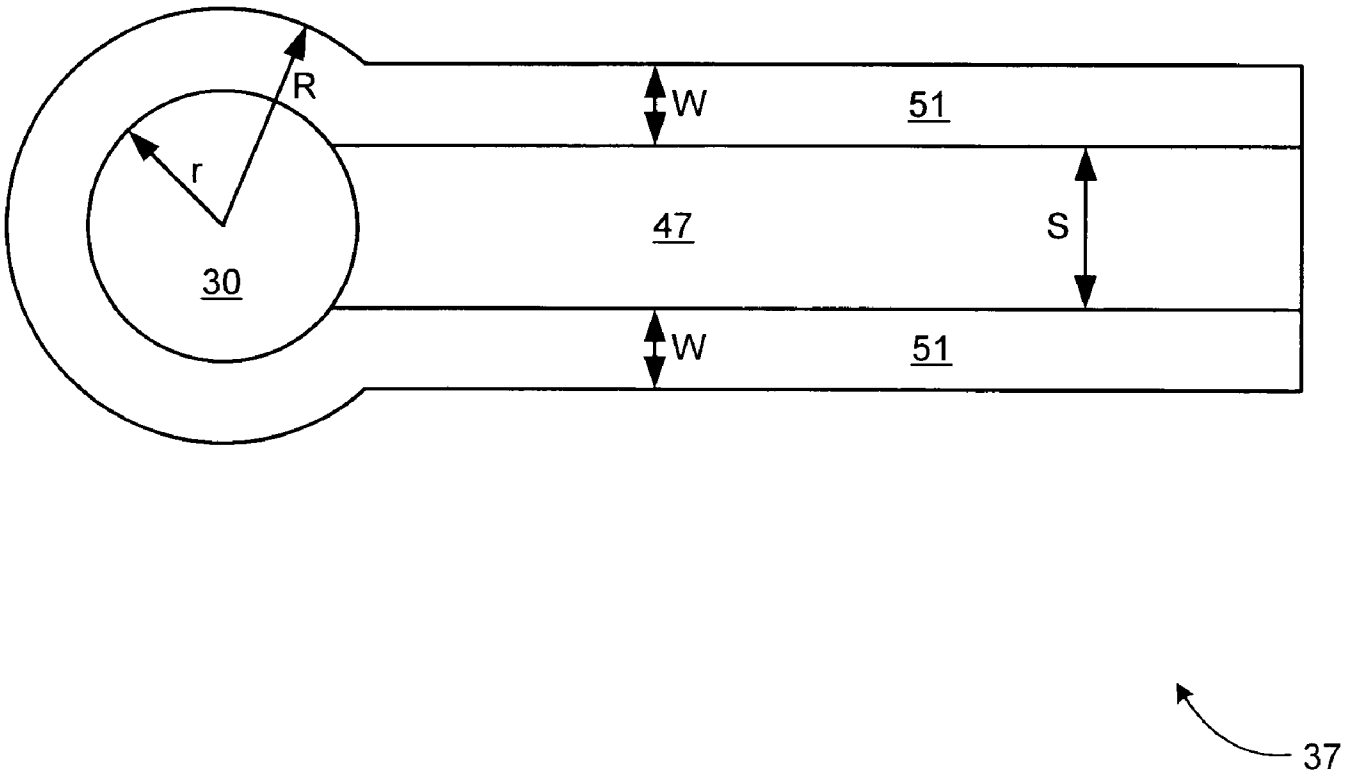
FIG. 6 is a diagram of the coplanar waveguide of FIG. 4.

FIG. 6 is a diagram of the coplanar waveguide 37 of FIG. 4. This coplanar waveguide 37 may be used on nonlimiting exemplary substrate constructed of silicon, sapphire, or glass with acceptable impedance values. The gap 51 may have width, w, so as to isolate conductor 47, which is electrically connected to the monopole antenna column 30. This electrical connection is the 2-D to 3-D transistor point. As a nonlimiting example, the gap 51 may have a width of approximately 50 μm and the ground may be assumed to be infinite. A calculated characteristic impedance on substrates constructed of silicon, sapphire, or glass (nonlimiting examples) may be between 50 Ω and 60 Ω with a central conductor 47 having a width, s, of approximately 80 μm.

Figure 7:
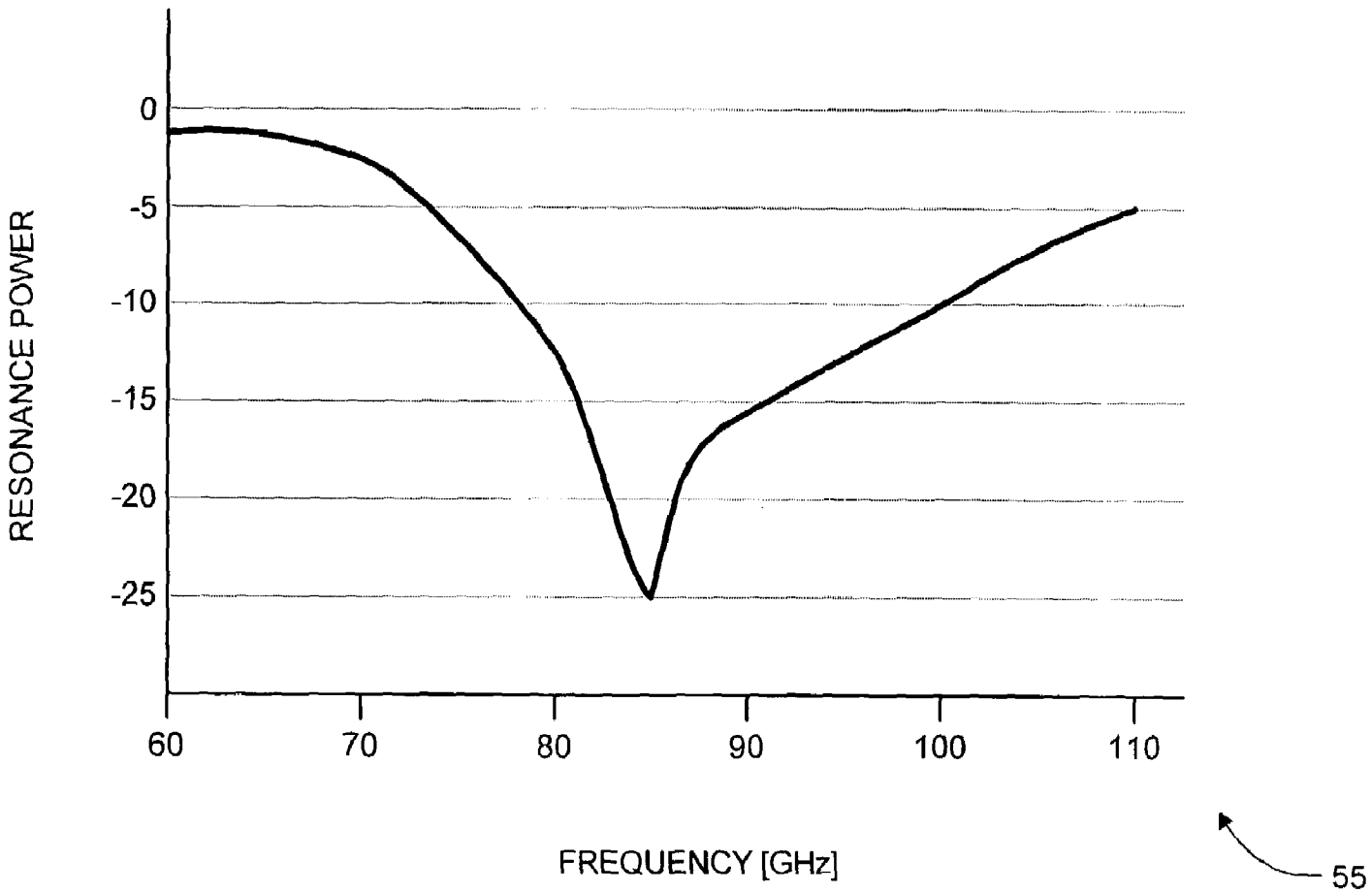
FIG. 7 is a nonlimiting exemplary chart depicting the reflection loss of the monopole antenna of FIG. 4.

FIG. 7 is a nonlimiting exemplary chart depicting the reflection loss of an antenna such as monopole antenna 35 of FIG. 4. The chart 55 illustrates a resonance at a frequency of approximately 85 GHz. One of ordinary skill in the art would likewise recognize that a far-field radiation pattern for such an antenna would be omnidirectional and symmetric.

Figure 8:
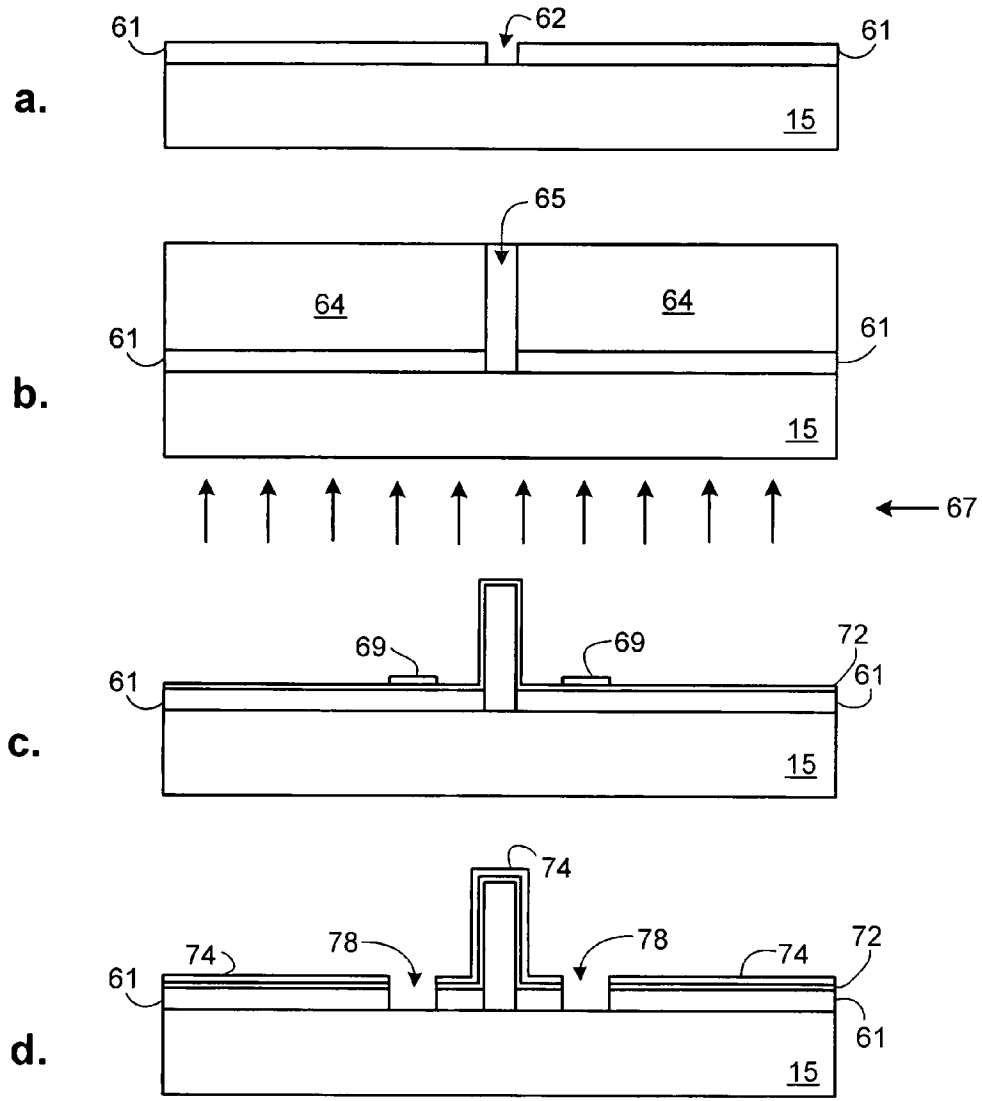
FIG. 8 is a diagram depicting a nonlimiting exemplary fabrication process for the monopole antenna of FIG. 4 using an epoxy core conductor technique.

FIG. 8 is a diagram depicting a fabrication process 60 for the monopole antenna 35 of FIG. 4 using an epoxy-core conductor technique. As a nonlimiting example, a photodefinable epoxy, such as SU-8, may be used as the backbone 27 in FIG. 3. In this nonlimiting example, SU-8 may be used due to its high-aspect-ratio micropatterning. Also as a nonlimiting example, electroplated gold may be used for the electrical conductive path coating 30 that may be placed around backbone 27. The skin depth of the gold in the W-band (75 GHz–110 GHz) may be in the range of 0.30 μm to 0.24 μm, as a nonlimiting example. In this nonlimiting example, five times the skin depth may be considered to be sufficient to minimize the RF conductor loss and thereby not degrade the electrical performance.

In returning to FIG. 8, in stage "a," glass substrate 15 has a chromium layer 61 patterned to allow for receipt of the monopole antenna column 65 at position 62. As a nonlimiting example, chromium may be patterned using standard photolithography. In stage "b," as a nonlimiting example, SU-8 epoxy 64 may be coated on top of chromium layer 61 to a thickness that will define the height of monopole 65. In this nonlimiting example, the SU-8 epoxy layer 64 may be approximately 800 μm thick. In this second stage "b," ultraviolet energy 67 may be exposed from the substrate 15 side so that the SU-8 epoxy layer obtains a uniform column latent pattern. As an alternative embodiment, front side exposure of ultraviolet energy 67 may be used if substrate 15 is opaque, such as if composed of Si, GaAs, etc.

In stage "c," of FIG. 8, a latent pattern is developed. Metal deposition of titanium and copper 72 may be used to form a conformal seed layer. As a nonlimiting example, one of ordinary skill in the art would know that a DC sputterer may be used to form the titanium and copper conformal seed layer 72. Two SU-8 epoxy deposits 69 may be placed atop of the titanium and copper layer 72 by a spin-coated and pattern process to define the signal path for the monopole antenna. The SU-8 epoxy deposits 69 may also be used to define the ground pads as well. A proximity photolithography process may be used to create the signal path and ground pads, as one of ordinary skill in the art would know.

In stage "d," of FIG. 8, gold layer 74 with a nonlimiting exemplary thickness of 2 μm may be uniformly electrodeposited through a bottom mold, as well as over the column surface. The SU-8 epoxy deposits 69, the titanium and copper seed layer 72, and the chromium layer 61 may be removed at position 78 (for creating a CPW) to complete the fabrication process.

One of ordinary skill in the art would know that a 2-mask process may be implemented to create the antenna of FIG. 8. In order to obtain more accurate bottom electrode dimensions for the signal and ground lines, bottom line metalization can be performed separately at positions 78 from the monopole metalization with an additional mask step. Nevertheless, the process described above in regard to FIG. 8 may take place at temperatures less than 100° C.; therefore, this process is CMOS compatible and integratable with a variety of different substrate types.

Figure 9:
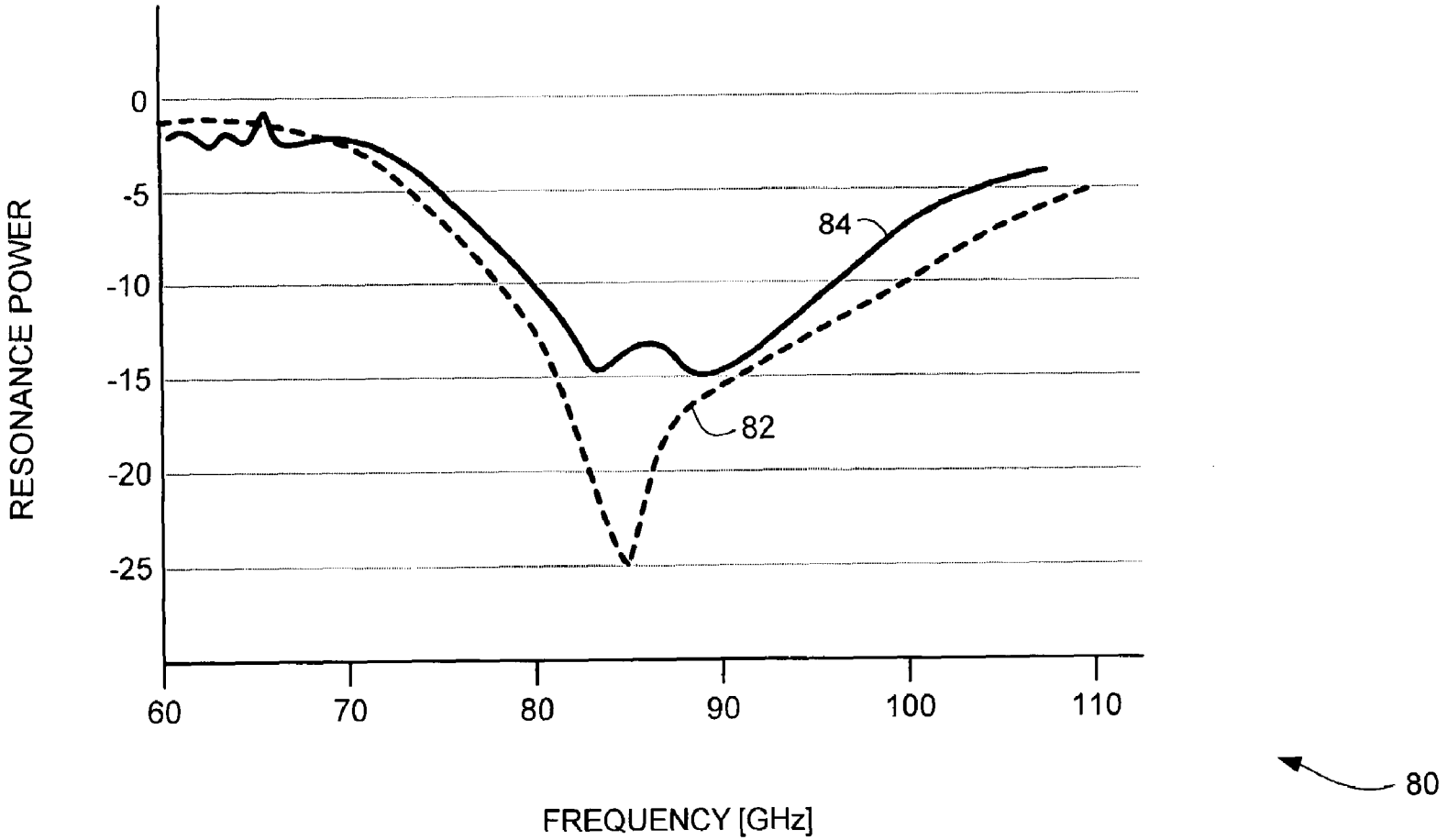
FIG. 9 is a graph depicting a measured and simulated reflection power for a monopole antenna that may be fabricated according to the steps depicted in FIG. 8.

FIG. 9 is a graph 80 depicting a measured and simulated reflection power for a monopole antenna 35, as fabricated according to the steps depicted in FIG. 8. In this nonlimiting example, the monopole antenna 35 has a monopole height of approximately 800 μm. Dashed line 82 in graph 80 represents a simulated return loss for the single monopole antenna 35 of FIG. 4 as may be fabricated according to the steps in FIG. 8. The frequency range of interest is from 50 to 100 GHz.

Solid line 84 represents an actual measured signal loss that may be obtained for a monopole antenna having the attributes described herein and as shown in FIGS. 4 and 8. As evident from graph 80, a return loss of 16 dB may be measured for this nonlimiting exemplary monopole antenna resonating at 85 GHz. As evident from graph 80, the measured return loss of such a monopole antenna generally agrees with the simulated value depicted in line 82.

The monopole antenna 35 of FIG. 4 that may be constructed according to the exemplary method FIG. 6 may inherently possess the property of omnidirectional radiation, as one of ordinary skill in the art would know. However, certain applications may call for high directivity, such as local chip communication or directional radiation with a low power budget. In these nonlimiting examples, an omnidirectional monopole antenna may not be appropriate.

Thus, a monopole array may provide more directivity and, therefore, may be more desirable in these instances. By placing various parasitic monopoles on the ground plane nearby a driving monopole, directivity may be increased in the same manner as a conventional dipole task driven Yagi-Uda antenna with directors and reflectors placed in proximity to the driving dipole. With the help of the ground as a mirror plane, a monopole-driven vertical Yagi-Uda antenna, or a M-Yagi antenna, may be implemented.

Figure 10:
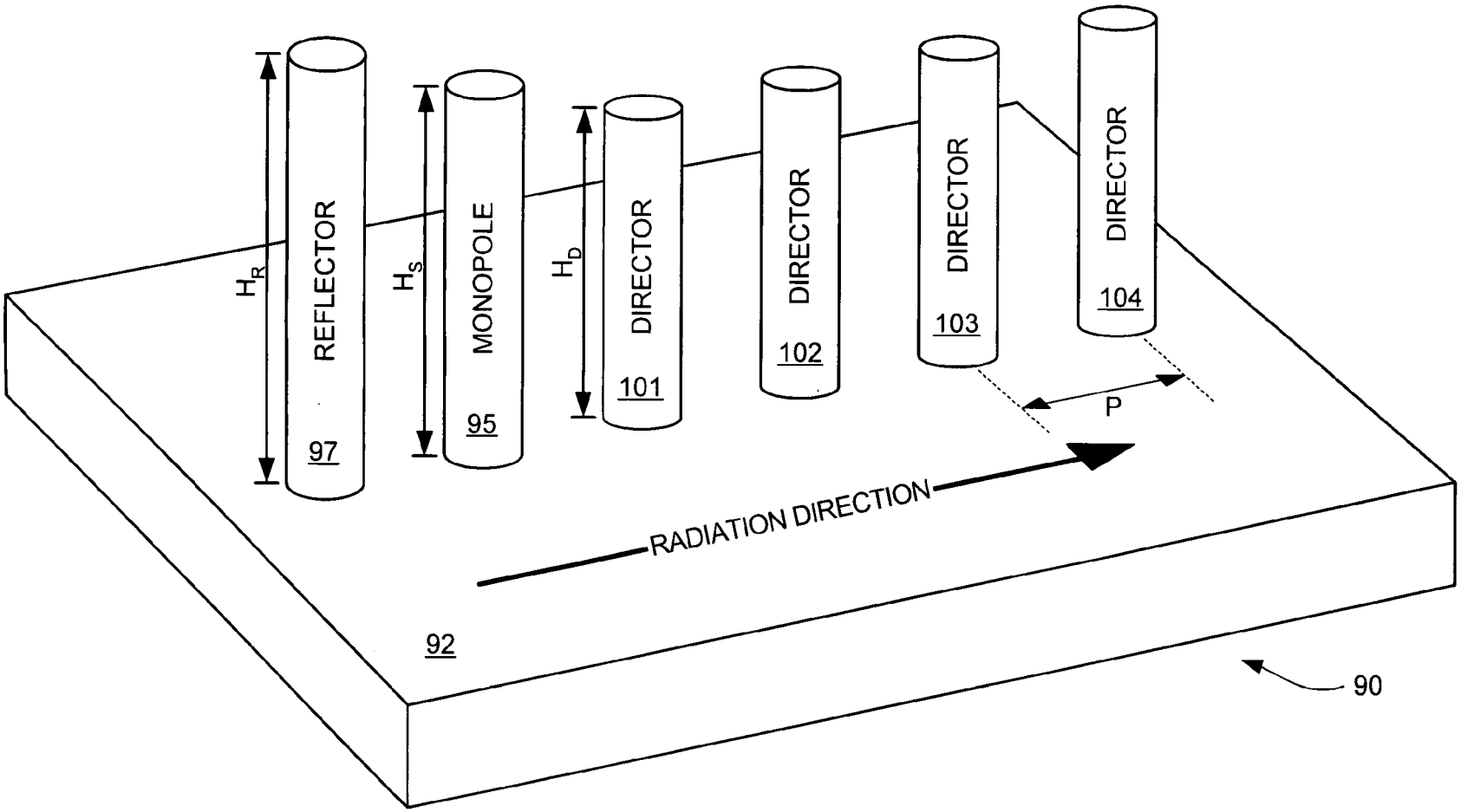
FIG. 10 is a nonlimiting exemplary diagram of a Yagi-Uda antenna with a plurality of monopoles, such as shown in FIG. 4.

FIG. 10 is a nonlimiting exemplary diagram of a Yagi-Uda antenna 90 with a plurality of monopoles, such as shown in FIG. 4. This Yagi-Uda antenna 90 of FIG. 10 consists of one driving monopole 95, one reflector monopole 97, and four director monopoles 101–104. A coplanar waveguide (CPW) feed (not shown) may be connected to the driving monopole 95, as one of ordinary skill in the art would know.

This Yagi-Uda antenna 90 of FIG. 10 may exhibit high radiation efficiency with minimum substrate effects due to an air-extruded architecture. The coplanar waveguide fed monopole 95 may alleviate application of complicated matching baluns or transformers. Moreover, as described in more detail below, the Yagi-Uda antenna 90 of FIG. 10 may be fabricated via a low-temperature CMOS compatible process that allows for integration on other RF chips in a post-processing fashion.

In the nonlimiting example of FIG. 10, the Yagi-Uda antenna 90 may be constructed with a reflector having a height that is the tallest of all monopoles in this Yagi-Uda antenna 90. The driving monopole 95 may have the next tallest height followed by directors 101–104 each having the same height that is the shortest of the three types of monopoles in FIG. 10. As a nonlimiting example, the reflector monopole 97 may have a height of 800 μm. Director monopole 95 may, in this nonlimiting example, have a height of 715 μm. Finally, each of directors 101–104 may be erected to a height of 560 μm. The spacing P between each monopole element in the Yagi-Uda antenna 90 that is fashioned on substrate 92 may have a spacing of approximately 480 μm. For this configuration, a simulated radiation pattern may provide for a maximal directivity of approximately 8.2 dBi in the horizontal axis.

Figure 11:
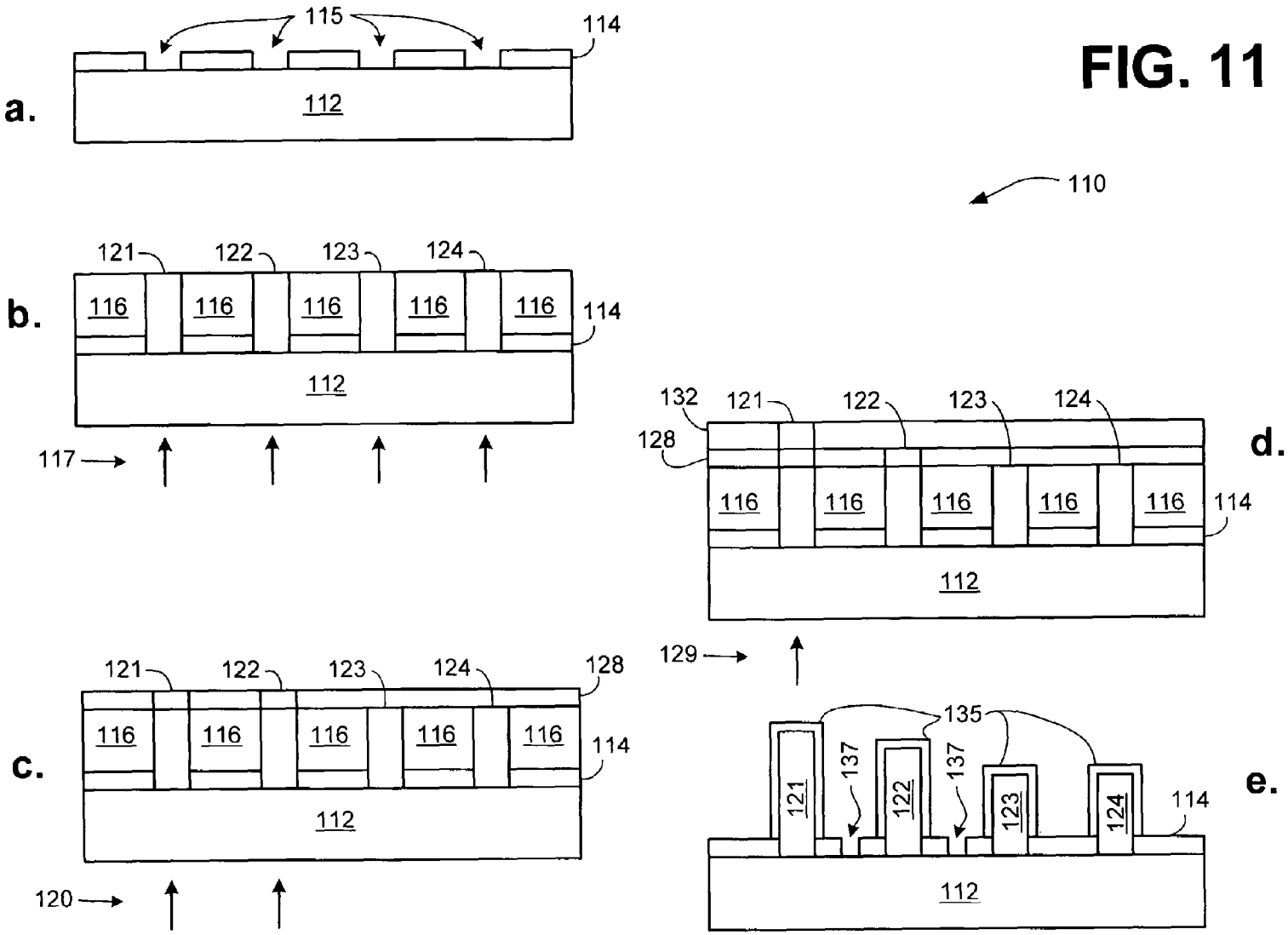
FIG. 11 is a diagram of an exemplary manufacturing process to fabricate the Yagi-Uda antenna of FIG. 10.

FIG. 11 is a diagram 110 of a micromachining manufacturing process that may be used to fabricate the Yagi-Uda antenna 90 of FIG. 10. In a first stage "a," chromium 114 may be patterned onto a glass substrate 112 so as to create positions 115 for the various director, reflector, and driving monopoles. In stage "b" of FIG. 11, a layer of photopatternable SU-8 epoxy 116, as a nonlimiting example, may be spin coated and photopatterned on the chromium layer 114. This photopatterning of SU-8 epoxy 116 defines the height of the reflector monopole 97 of FIG. 10, which is referenced as reflector 121 in FIG. 11. Ultraviolet energy 117 may be exposed to the substrate 112 so as to achieve a relatively uniform column latent pattern for the monopoles 121–124 in stage "b."

In stage "c" of FIG. 11, ultraviolet energy 120 may be applied to the monopole positions 121, 122 which may be the reflector and driving monopoles, respectively. This operation ultimately results in a portion 128 of the SU-8 epoxy 116 being removed, thereby creating the distinguished heights as described above.

Continuing to stage "d" of FIG. 11, ultraviolet energy 129 may be focused on reflector monopole 121 so that SU-8 epoxy 116 is further removed to create the differentiated levels between the monopoles 122, 123, and 124. Subsequently, the remaining portion of the SU-8 epoxy 116 is removed to create the Yagi-Uda antenna 90 shown in stage "e." As described above, the monopoles may be coated with a metal such as gold layer 135 through an electroplating process using proximity lithography, as similarly described above. Likewise, signal paths 137 may be created as similarly described above around the driving monopole 122 (monopole 95 in FIG. 10).

Figure 12:
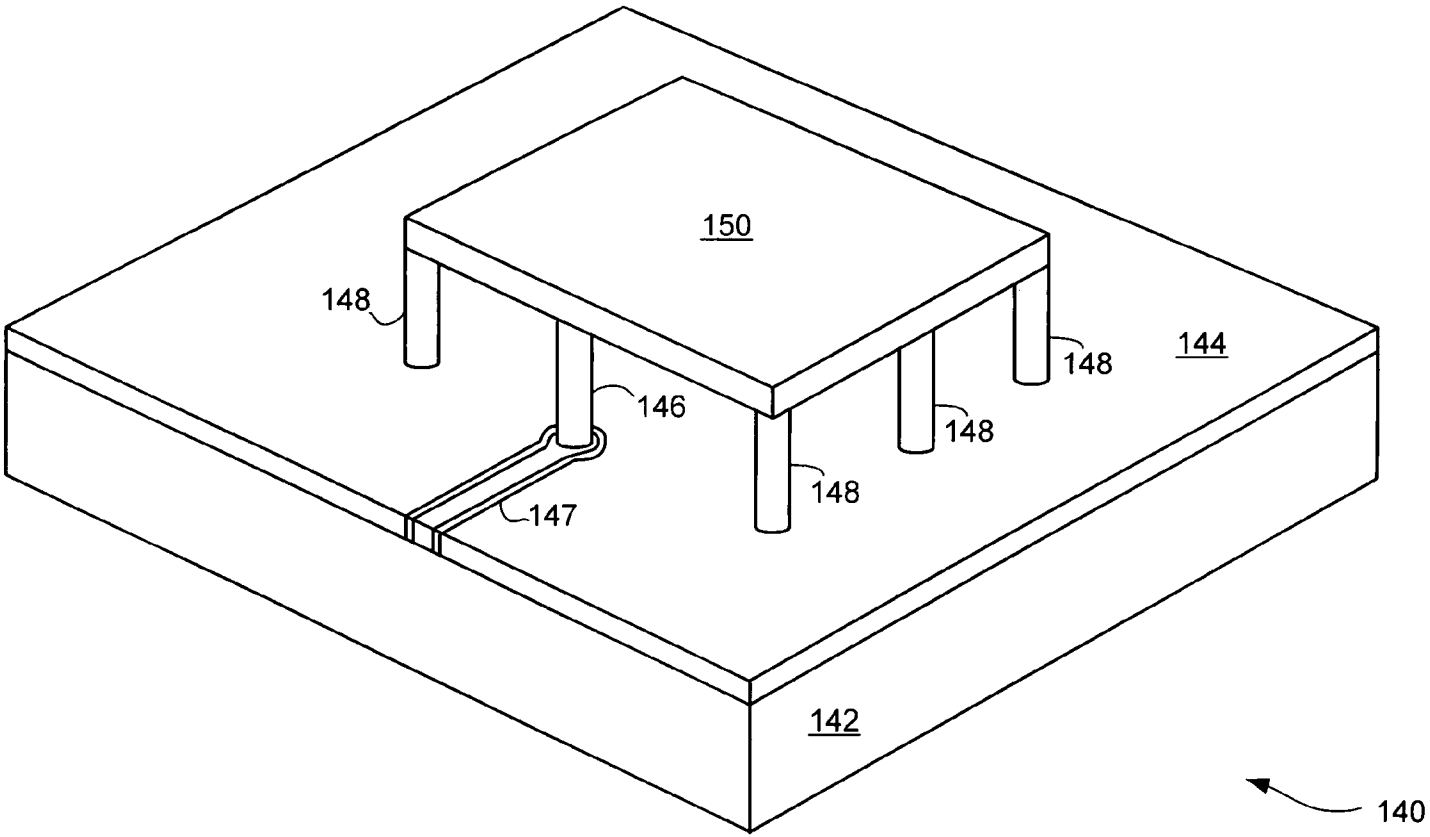
FIG. 12 is a diagram of a monopole-driven air-lifted patch antenna using one or more monopoles, as shown in FIG. 4, and a fabrication process, as similarly depicted in FIG. 8.

FIG. 12 is a diagram of a monopole-driven air-lifted patch antenna 140 for Ka-band (20 GHz–30 GHz) application using one or more monopoles, as shown in FIG. 4 and a fabrication process, as similarly described in regard to FIG. 8. The elevated patch antenna 140 is placed on substrate 142 and ground plane 144. A metal patch 150 is supported by a metal coated epoxy core monopole 146, as constructed according to the fabrication techniques described above. Metal patch 150 is also supported by structural polymer supporting posts 148 that may, as a nonlimiting example, be configured of SU-8 epoxy. A coplanar wave guide 147 (as similarly shown in FIG. 6) feeds the metal coated epoxy-core monopole 146. Lifting the metal patch 150 from the substrate 142 and ground plane 144 improves the substrate related loss and bandwidth.

The metal coated monopole 146 is coupled to the coplanar waveguide 147 in similar fashion as described above to create an effective 3-D transition. The coplanar waveguide 147 is used in this nonlimiting example because it helps remove the air-dielectric interface between the patch and the ground metal and also because the coplanar waveguide 147 and metal patch 150 can share the same ground on top of the substrate.

The elevated patch antenna 140 of FIG. 12 may be fabricated by a combination of epoxy-core technique as described above, as well as laser machining an electroplating bonding, as one of ordinary skill in the art may know.

Figure 13:
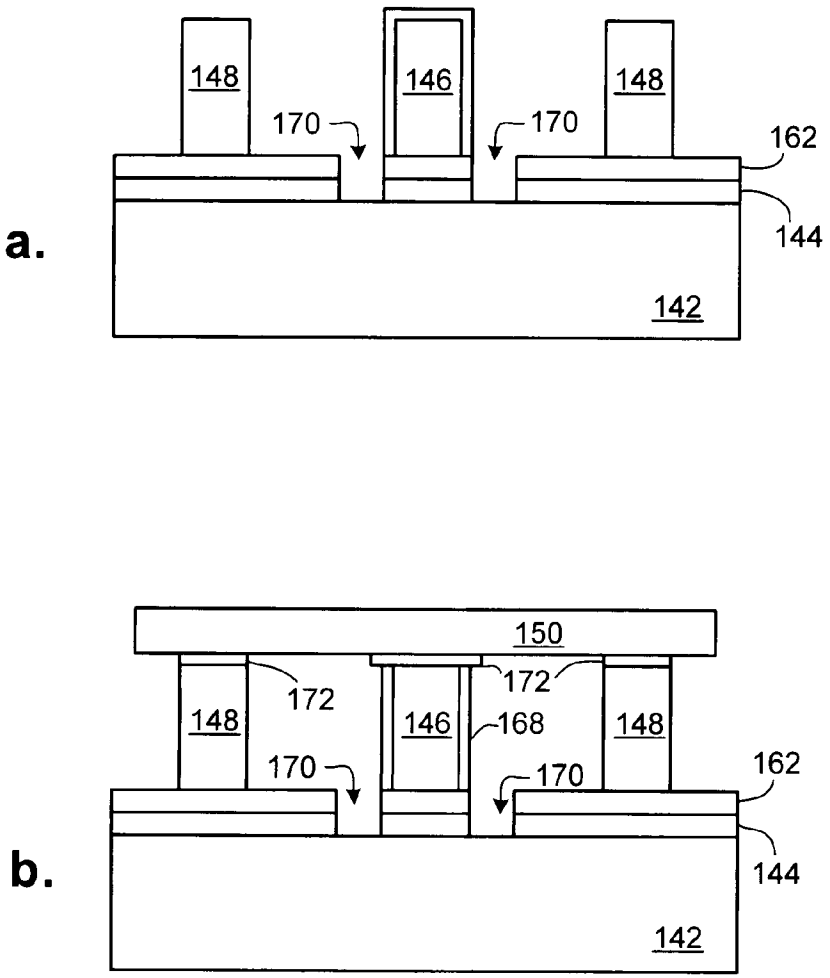
FIG. 13 is a diagram of an exemplary manufacturing process that may be used to create the air-lifted patch antenna of FIG. 12.

FIG. 13 is a diagram of a manufacturing process that may be used to create this air-lifted patch antenna of FIG. 12. In this nonlimiting example, the ground plane 144 may be positioned on substrate 142, as described above. Chromium layer 162 may be similarly placed on the ground layer 144, as described above as well. Monopole columns 148 may be constructed of the SU-8 epoxy, as a nonlimiting example. Electroplated copper 168 may be used in this nonlimiting example on the center monopole 146 to feed the metal patch 150 of FIG. 12. As a nonlimiting example, the monopoles 148 may be constructed of SU-8 epoxy to the height of approximately 600 μm using the UV photolithography process described above. The feeding monopole 146 may be selectively metalized using photolithography and electrodeposition to provide a signal path from the coplanar waveguide 147 to the metal patch 150. The electroplated copper 168 may have a thickness of approximately 100 μm that may be fabricated by laser ablation.

As shown in stage "b," a metal patch 150 may be adhered to the supporting poles 148 and the center monopole 146 by using a conductive paste 172, as a nonlimiting example. One of ordinary skill in the art would know, however, that other adhering materials and substances may be used instead of the conducting paste 172.

Signal paths 170 may be created according to the same processes described above for creating the coplanar waveguide 147. After adhering the metal patch 150 to the posts 146, 148 with the conductive paste 172, additional copper electrode plating bonding between the feeding monopole 146 and the metal patch 150 may be performed to a thickness of approximately 30 μm to strengthen the connection.

Figure 14:
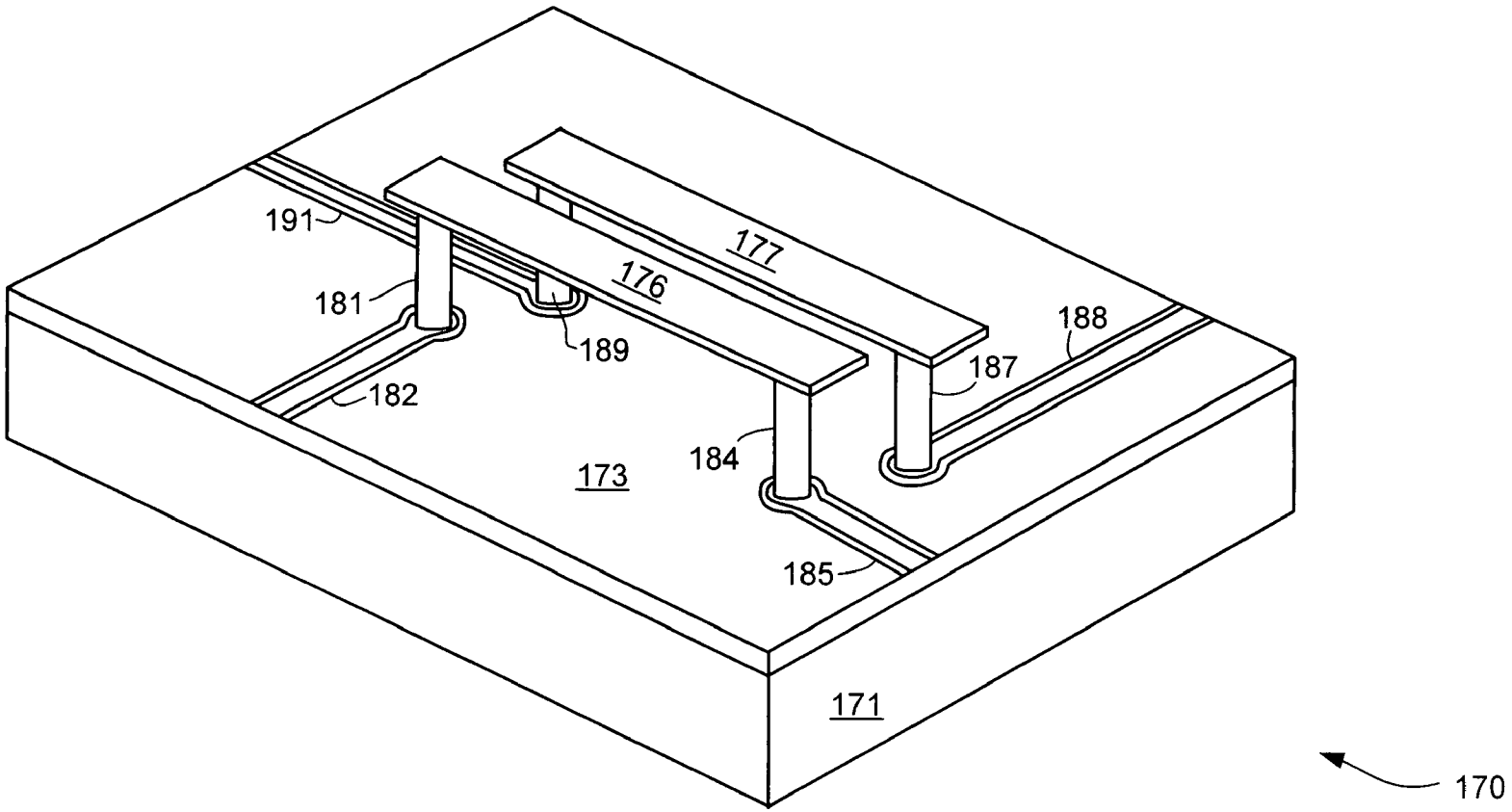
FIG. 14 is a diagram of a broadband air-lifted microstrip coupler fabricated with a plurality of monopoles, as depicted in FIG. 4.

FIG. 14 is a diagram of a broadband air-lifted microstrip coupler 170 fabricated with a plurality of monopoles as described above (i.e., such as in FIG. 4). Two parallel bridges 176, 177 are air-coupled and fed by a combination of epoxy-core metal posts 181, 184, 187, and 189, as well as coplanar waveguides 182, 185, 188, and 191. Parallel bridges 176, 177 are elevated to a height several hundred micrometers above the substrate 171 and ground plane 173, which reduces electromagnetic coupling between the waveguides and the substrate. Also, the elimination of the dielectric/air interface around the coupler 170 helps to reduce the mode dispersion and associated problems, such as poor isolation. This nonlimiting exemplary air-lifted coupler 170 can be considered as a method to develop high performance RF front end components on lossy substrates.

Figure 15:
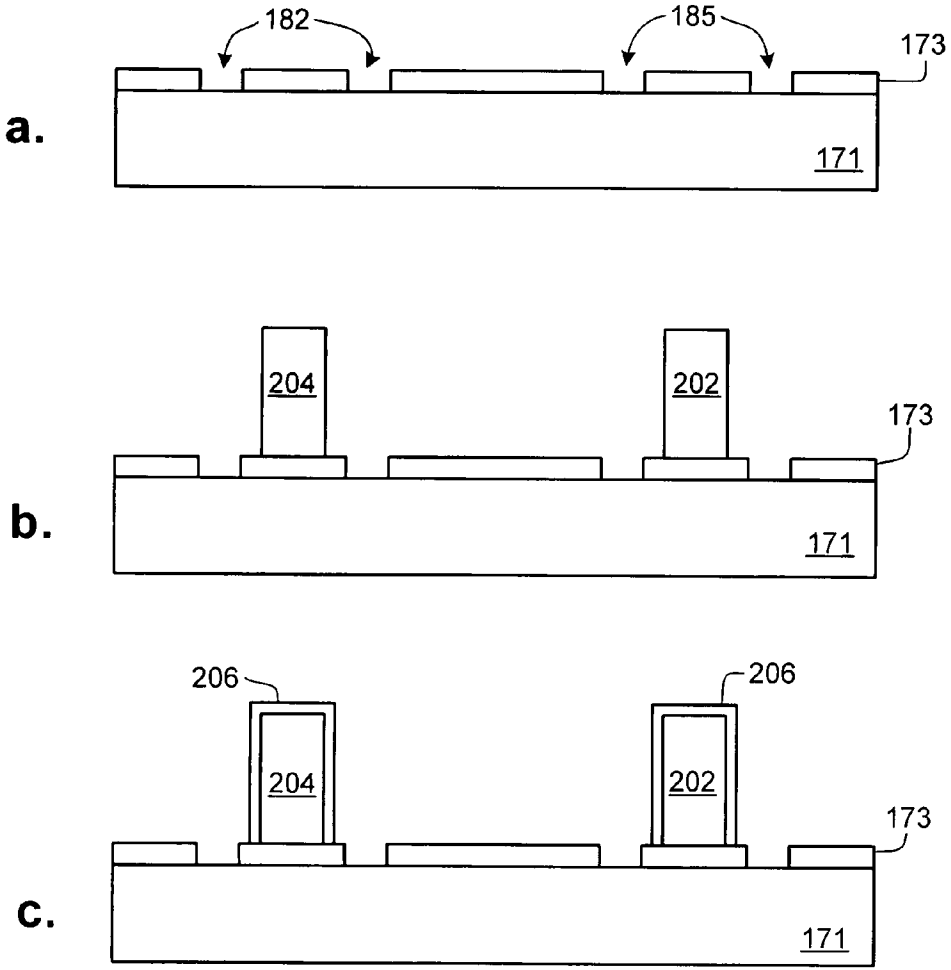
FIGS. 15 and 16 are diagrams of a fabrication process that may be utilized to create the air-lifted coupler of FIG. 14.
Figure 16:
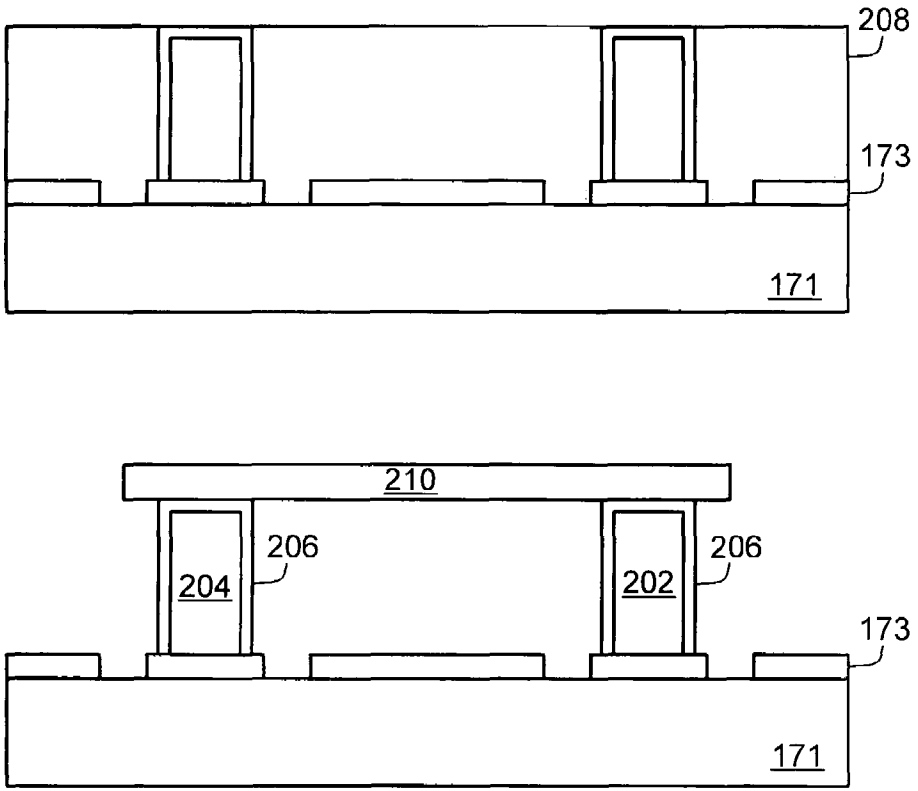

FIGS. 15 and 16 are diagrams of a fabrication process 200 that may be used to create the air-lifted coupler 170 of FIG. 14. In this nonlimiting example, the coplanar waveguides 182 and 185 of FIG. 14 and the ground plane 173 are patterned on substrate 171 using chromium and gold, as shown in stage "a." In this nonlimiting example, substrate 171 may be comprised of a soda-lime glass material. SU-8 epoxy may be spincast and patterned in stage "b" for definition of posts 202 and 204. As a nonlimiting example, the feeding posts 202, 204 may have a height of 190 μm. Conformal seed layers of titanium and copper may be deposited using a DC sputterer, as described above. Negative-tone photoresist material is spincoated and lithographically patterned, allowing copper 206 to selectively coat posts 202, 204 with a thickness of approximately 15 μm, according to at least one nonlimiting example (stage "c"). A sacrificial polymer 208 in stage "d" of FIG. 16 may be used as a mechanical support for the subsequent bridge patterning. Seed layers of titanium and copper for bridge patterning may be deposited, followed by photoresist casting and patterning on the casting as well. After copper electrodeposition with a thickness of approximately 10 μm, removal of the polymer 208 may follow, as well as the seed layers and sacrificial layers in order to complete the process, as shown in stage "e" of FIG. 16.

As a result of this fabrication process, the air-lifted coupler 170 of FIG. 14 includes an approximate 190 μm air gap between the coupler and ground substrate 173. In at least one nonlimiting example, the air-lifted coupler 170 may demonstrate a broadband coupling of 12.5 dB and a matching better than 10 dB over 15–45 GHz. In this nonlimiting example, the air-lifted coupler 170 may also exhibit a through transmission of 0.015–1.58 dB over 15–45 GHz.

Figure 17:
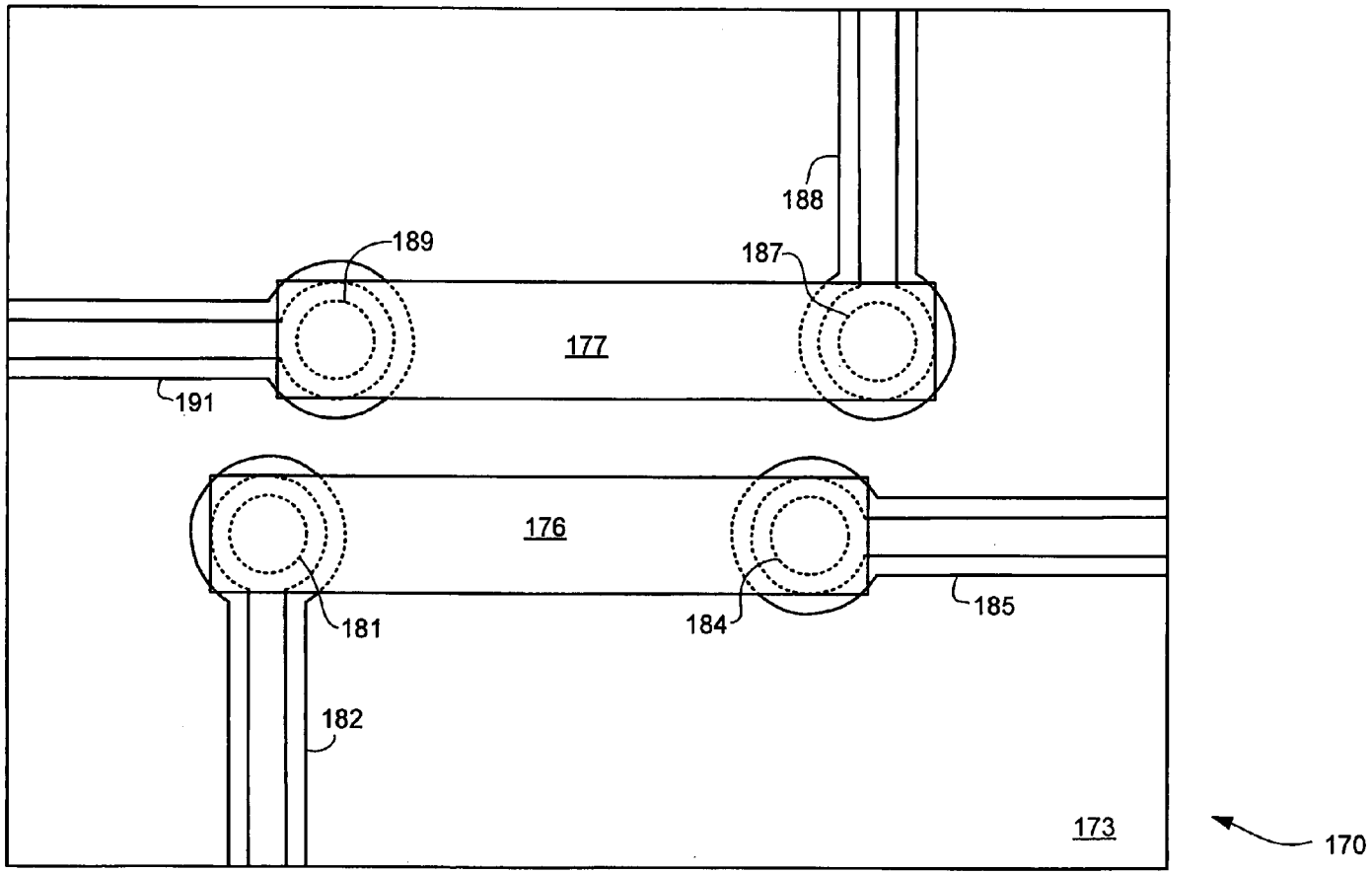
FIG. 17 is a top view diagram of the air-lifted coupler of FIG. 14.

FIG. 17 is a top view of the air-lifted coupler 170 of FIG. 14. In this diagram, the bridges 176 and 177 of the air-lifted coupler 170 are positioned proximate to each other as supported above ground plane 173 by posts 181 and 184 for bridge 176 and posts 187 and 189 for bridge 177.

FIG. 18 depicts a magnetically-lifted monopole antenna 215. The antenna 215 in this nonlimiting example is comprised of a soft metal, such as gold 217, for plastic deformation during bending, and a ferromagnetic level 219 for magnetic-forced-based deflection. In this nonlimiting example, ferromagnetic metal 219 may be comprised of NiFe. A cantilever is fabricated using a photoresist mold 224 that is patterned in an electrodeposition processes as described above, which may also include the placement of a chromium layer 222 on substrate 220.

After the cantilever is released, it is erected vertically using an external magnetic field. The erected structure 215 stays in the vertical position after plastic deformation of the gold layer, as shown in the lower drawing of FIG. 18. As a nonlimiting example, the fabricated magnetically-lifted structure 215 may have a width of approximately 80 μm and a length of approximately 2 mm. The thickness of the gold layer 217 and the ferromagnetic layer 219 may be, as nonlimiting examples, 5 and 6 μm, respectively. The air-lifted structure 215 may show a monopole antenna performance in far-field radiation. As a nonlimiting example, a return loss of 24 dB at 35 GHz with a bandwidth of 20.7% may be realized.

It should be emphasized that the above-described embodiments and nonlimiting examples are merely possible examples of implementations, merely set forth for a clear understanding of the principles disclosed herein. Many variations and modifications may be made to the above-described embodiment(s) and nonlimiting examples without departing substantially from the spirit and principles disclosed herein. All such modifications and variations are intended to be included herein within the scope of this disclosure and protected by the following claims.

We claim:

1. A micromachined antenna, comprising:

a coplanar waveguide having a conductor path and coupled to a substrate material; and a monopole conductor having a generally cylindrical backbone erected vertically from the substrate material and a metal layer deposited on the backbone at a predetermined thickness and in electrical communication with the conductor path and isolated from electrical communication from the substrate material.

2. The antenna of claim 1, wherein the substrate material includes a first material having a second material thereon that operates as a ground plane.

3. The antenna of claim 2, wherein the first material comprises one of a group that includes glass, silicon, and sapphire.

4. The antenna of claim 1, wherein the height of the monopole conductor is greater than 800 μm.

5. The antenna of claim 1, wherein the backbone is constructed of epoxy material that is sensitive to near ultraviolet radiation.

6. The antenna of claim 1, further comprising:

a reflector monopole erected a predetermined distance from the monopole conductor at a height that is greater than the monopole conductor, the reflector monopole having a backbone of a first material and a metal layer deposited on the backbone; and a plurality of director monopoles erected in a line created by the reflector monopole and the monopole conductor, the plurality of director monopoles having a height that is less than the monopole conductor and positioned apart from each other according to the predetermined distance.

7. The antenna of claim 6, wherein the reflector monopole, metal layered backbone, and the plurality of director monopoles are oriented so as to direct electromagnetic energy in a predetermined direction that is not omnidirectional.

8. The antenna of claim 1, wherein at least one director monopole is positioned from the monopole conductor according to the predetermined distance.

9. The antenna of claim 1, further comprising:

a plurality of nonconductive monopoles erected proximate to the monopole conductor at a height that is equal to the height of the monopole conductor; and a metal patch coupled on top of the monopole conductor and the plurality of nonconductive monopoles so that the metal patch is in electrical communication with the monopole conductor and secured by a conductive adhesive substance.

10. The antenna of claim 1, further comprising:

first and second monopole conductors coupled to a first coupler strip metal positioned on top of the first and second monopole conductors so that the first coupler strip is elevated from the substrate;

third and fourth monopole conductors coupled to a second coupler strip metal positioned on top of the third and fourth monopole conductors so that the second coupler strip is elevated from the substrate; and wherein each of the first, second, third, and fourth monopole conductors is coupled to a separate coplanar waveguide, and wherein first and second coplanar waveguides are generally parallel to each other.

11. A magnetically-lifted micromachined monopole antenna, comprising:

a substrate having a coplanar waveguide;

a deformable metal monopole formed on a removable photoresist mold having a bend and electrically coupled to a signal path in the coplanar waveguide; and a ferromagnetic metal deposited on the metal monopole, wherein the metal monopole is deflected to a vertical position when the ferromagnetic metal is subjected to a magnetic field.

12. The magnetically lifted monopole antenna of claim 11, wherein the height of the deflected deformable metal monopole above the substrate extends to greater than 2 millimeters.

13. The magnetically lifted monopole antenna of claim 11, wherein the metal of the deformable metal monopole is gold, and the ferromagnetic metal is NiFe.

14. A method for an electromagnetic energy radiating micromachined antenna having a monopole, comprising the steps of:

depositing an epoxy material on a ground plane coated substrate to a predetermined thickness, wherein the ground plane is patterned;

exposing the ground plane coated substrate and the epoxy material to an ultraviolet source so that a monopole column develops in accordance with the patterned ground plane;

forming a seed layer of a metal on the ground plane and the developed column; and electrodepositing a conductive metal over the column surface to produce a monopole antenna.

15. The method of claim 14, further comprising the steps of:

coating a portion of the seed layer in a predetermined pattern to define a signal path for electrical communication between the signal path and the monopole antenna.

16. The method of claim 14, wherein the substrate is glass, the ground plane is created by chromium, the seed layer is a metal having titanium and copper, and the conductive metal is gold.

17. The method of claim 14, further comprising the steps of:

positioning a reflector monopole having a metal exterior and a nonmetal interior and having a height that is greater than the monopole antenna and position that is a predetermined distance from the monopole antenna; and positioning one or more director monopoles each having a metal exterior and a nonmetal interior and having a height that is less than the monopole antenna, wherein a first director monopole is positioned at a position that is the predetermined distance from the monopole antenna and wherein each remaining director monopole of the one or more director monopoles is positioned the predetermined distance from another director monopole.

18. The method of claim 17, wherein a first portion of the epoxy material is removed after exposure of the epoxy material to an ultraviolet source for a predetermined time so that the reflector monopole has a height above the ground plane that is equal to the predetermined thickness, and further a second portion of the epoxy material is removed after exposure to the ultraviolet source for a predetermined time so that the monopole antenna has a height above the ground plane that is less than the height of the reflector monopole, and further a third portion of the epoxy material is removed after exposure to the ultraviolet source for a predetermined time so that each of the one or more director monopoles has a height that is less then the height of the monopole antenna, wherein each of the reflector monopole and the one or more director monopoles are coated in a metal.

19. The method of claim 14, further comprising the steps of:

positioning a plurality of nonconductive monopoles a predetermined distance from the monopole antenna;

adhering a metal patch onto a end of the monopole antenna and each of the plurality of nonconductive monopoles so that the metal path is elevated above the substrate; and forming a coplanar waveguide in the ground plane so that a signal path is electrically coupled to the monopole antenna and the metal patch.

20. The method of claim 14, further comprising the steps of:

positioning three conductive monopoles a predetermined distance from the monopole antenna, wherein each of the conductive monopoles and the monopole antenna is electrically coupled to a separate coplanar waveguide;

adhering a first coupler metal to an end of the monopole antenna and to an end of a first conductive monopole so that the first coupler metal is elevated above the substrate; and adhering a second coupler metal to an end of a second conductive monopole antenna and to an end of a third conductive monopole so that the second coupler metal is elevated above the substrate and is essentially parallel to the first coupler metal.

21. A magnetically-lifted monopole antenna, comprising the steps of:

forming a metal monopole having a bended section on an epoxy sensitive to near ultraviolet radiation;

placing a ferromagnetic material on the metal monopole;

erecting the metal monopole with a magnetic force; and removing the epoxy with near ultraviolet radiation.

* * * * *

UNITED STATES PATENT AND TRADEMARK OFFICE

CERTIFICATE OF CORRECTION

PATENT NO. : 7,196,666 B2 
APPLICATION NO. : 11/145911
DATED : March 27, 2007
INVENTOR(S) : Allen et al.

It is certified that error appears in the above-identified patent and that said Letters Patent is hereby corrected as shown below:

Column 3, line 48: Please delete "," after "frequencies".

Column 12, line 28: Please delete "a" before "end" and replace it with --an--

Please Insert Figure 18 after sheet 17 as follows:

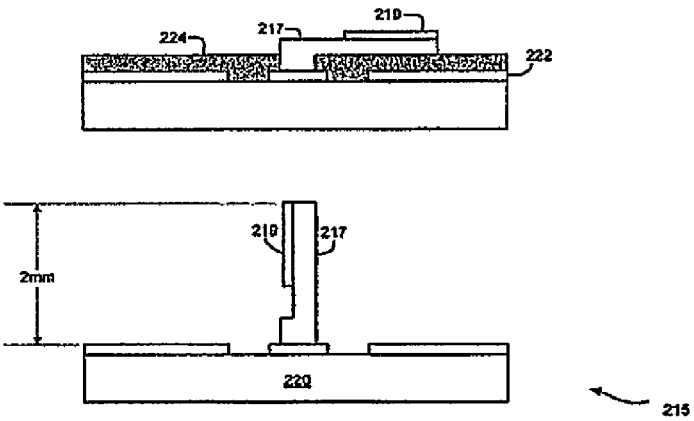

FIG. 18

Signed and Sealed this

Nineteenth Day of June, 2007

JON W. DUDAS
*Director of the United States Patent and Trademark Office*